US010165815B1

(12) United States Patent
Branker et al.

(10) Patent No.: US 10,165,815 B1
(45) Date of Patent: Jan. 1, 2019

(54) SHIRT STAY

(71) Applicants: Gladys Branker, Lincoln, NE (US); Rachel Branker, Bronx, NY (US)

(72) Inventors: Gladys Branker, Lincoln, NE (US); Rachel Branker, Bronx, NY (US)

( * ) Notice: Subject to any disclaimer, the term of this patent is extended or adjusted under 35 U.S.C. 154(b) by 154 days.

(21) Appl. No.: 15/011,840

(22) Filed: Feb. 1, 2016

(51) Int. Cl.

| | |
|---|---|
| ***A41F 19/00*** | (2006.01) |
| ***A41F 17/00*** | (2006.01) |
| ***A41F 1/00*** | (2006.01) |
| ***A41D 27/20*** | (2006.01) |

(52) U.S. Cl.
CPC ..... *A41F 17/00* (2013.01); *A41D 27/20* (2013.01); *A41F 1/008* (2013.01)

(58) Field of Classification Search
CPC ..... A41F 17/70; A41F 1/008; A41F 9/007; A41F 9/00; A41F 17/00; A41D 27/20; A41D 11/00; A41B 9/005; A41B 13/00
USPC ..... 2/300
See application file for complete search history.

(56) References Cited

U.S. PATENT DOCUMENTS

| | | | | | |
|---|---|---|---|---|---|
| 1,088,355 | A | | 2/1914 | Mcgee | |
| 1,282,878 | A | * | 10/1918 | Lagois | A45F 5/00 2/300 |
| 1,508,648 | A | * | 9/1924 | Crown | A41F 11/16 2/313 |
| 1,530,565 | A | | 3/1925 | Lindauer | |
| 1,584,476 | A | * | 5/1926 | Schalow | A41F 11/16 2/300 |
| 2,028,602 | A | | 1/1936 | Hanson | |
| 2,599,355 | A | | 6/1952 | Stepp | |
| 2,727,247 | A | * | 12/1955 | Bailey | A41F 17/00 2/117 |
| 4,074,364 | A | * | 2/1978 | Lucero | A41F 17/00 2/117 |
| 4,853,979 | A | | 8/1989 | Ryder | |
| 4,937,886 | A | * | 7/1990 | Ellis | A41F 17/00 2/323 |
| 5,177,813 | A | | 1/1993 | Bosack et al. | |

(Continued)

FOREIGN PATENT DOCUMENTS

| | | | |
|---|---|---|---|
| DE | 202009009094 | U1 | 12/2009 |
| JP | 2006083508 | A | 3/2006 |
| JP | 2007138367 | A | 6/2007 |

OTHER PUBLICATIONS

Anonymous, Vanguard® Shirt Garter—Black (4 pack), website page, http://tandtuniforms.com/shop/catalog/index.php?route=product/product&product_id=1291&search=SHIRT+GARTER, T& T Uniforms South, Inc., Jonesboro, GA, Dec. 16, 2015.

*Primary Examiner* — Timothy K Trieu
(74) *Attorney, Agent, or Firm* — Werschulz Patent Law, LLC; Patricia P. Werschulz, Esq.

(57) ABSTRACT

An adaptable shirt stay for maintaining shirttails in a flat and fully extended position. The shirt stay is provided in a kit that includes a pair of thigh bands, a crotch panel, a plurality of thigh belts and a plurality of straps having at least one clasp on one end for anchoring the shirttail to the thigh bands, the crotch panel or a combination of thigh bands and crotch panel. The straps are adjustable for accommodating a plurality of shirts of many different lengths and styles of shirttails. The shirt stay provides easy access to undergarments through a crotch panel that selectively opens when the shirt stay is in place. The shirt stay optionally has a plurality of downward straps with clasps attaching to the thigh bands for maintains stockings in place.

3 Claims, 11 Drawing Sheets

(56) References Cited

U.S. PATENT DOCUMENTS

| | | | | |
|---|---|---|---|---|
| 5,276,923 | A * | 1/1994 | Cohen | A41F 17/00 2/117 |
| 5,928,059 | A * | 7/1999 | Wicks | A41C 1/10 2/408 |
| 9,750,292 | B1 * | 9/2017 | Goldman | A41F 17/00 |

* cited by examiner

SHIRT STAY

TECHNICAL FIELD

The present disclosure relates generally to a clothing accessory. More particularly, the present disclosure relates to a shirt stay that maintains a shirttail in a flat and fully extended position.

BACKGROUND

A smooth, flat shirtfront with shirttails fully extended and tucked into a waistband presents a well-groomed and professional appearance. Conversely, a shirttail sticking out of the waistband or with a puckered shirtfront shouts sloppy and unkempt.

Many professions and organizations, such as policemen, military personnel, scouts and private schools require a well-groomed appearance that includes tucked-in shirttails.

Shirttails have a tendency over time to escape from the waistband. If the wearer is very active and moves around a lot, the shirttail naturally moves with the top of the torso and pulls out of the waistband. Shirttails especially challenge little children because their shirttails, while proportional to the shirt size, are relatively short.

Adult wearers who have a large waist and protruding stomach also have problems with shirttails. When the shirttail covers the protruding stomach, there is not sufficient material in the shirttail to securely tuck into the waistband.

Many have attempted to secure the shirttails through clasps in a large variety of configurations. These configurations generally are often ineffective, uncomfortable and inconvenient.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide an adaptable system for maintaining shirttails in a flat and fully extended position. Accordingly, the present disclosure provides a shirt stay kit that includes a pair of thigh bands, a crotch panel and a plurality of straps having a clasp on one end, the clasp anchoring the shirttail to the thigh bands, the crotch panel or a combination of thigh bands and crotch panel.

Another aspect of an example embodiment in the present disclosure is to provide a shirt stay that accommodates a plurality of shirts of many different lengths and styles. Accordingly, an aspect of an example embodiment in the present disclosure provides a shirt stay having adjustable elastic straps having a clasp on one end.

Yet another aspect of an example embodiment in the present disclosure is to provide a shirt stay that provides easy access to undergarments when the shirt stay is in place. Accordingly, an aspect of an example embodiment in the present disclosure provides a shirt stay having a crotch panel that selectively opens.

A further aspect of an example embodiment in the present disclosure is to provide a shirt stay that also maintains stockings in place. Accordingly, an aspect of an example embodiment in the present disclosure provides a shirt stay with a thigh band having a plurality of downward straps with clasps for stockings.

Accordingly, the present disclosure describes an adaptable shirt stay for maintaining shirttails in a flat and fully extended position. The shirt stay is provided in a kit that includes a pair of thigh bands, a crotch panel and a plurality of straps having a clasp on one end for anchoring a shirttail to the thigh bands, the crotch panel or a combination of thigh bands and crotch panel. The straps are adjustable for accommodating a plurality of shirts of many different lengths and styles of shirttails. The shirt stay provides easy access to undergarments through a crotch panel that selectively opens when the shirt stay is in place. The shirt stay optionally has a plurality of downward straps with clasps attaching to the thigh bands for maintaining stockings in place.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1:
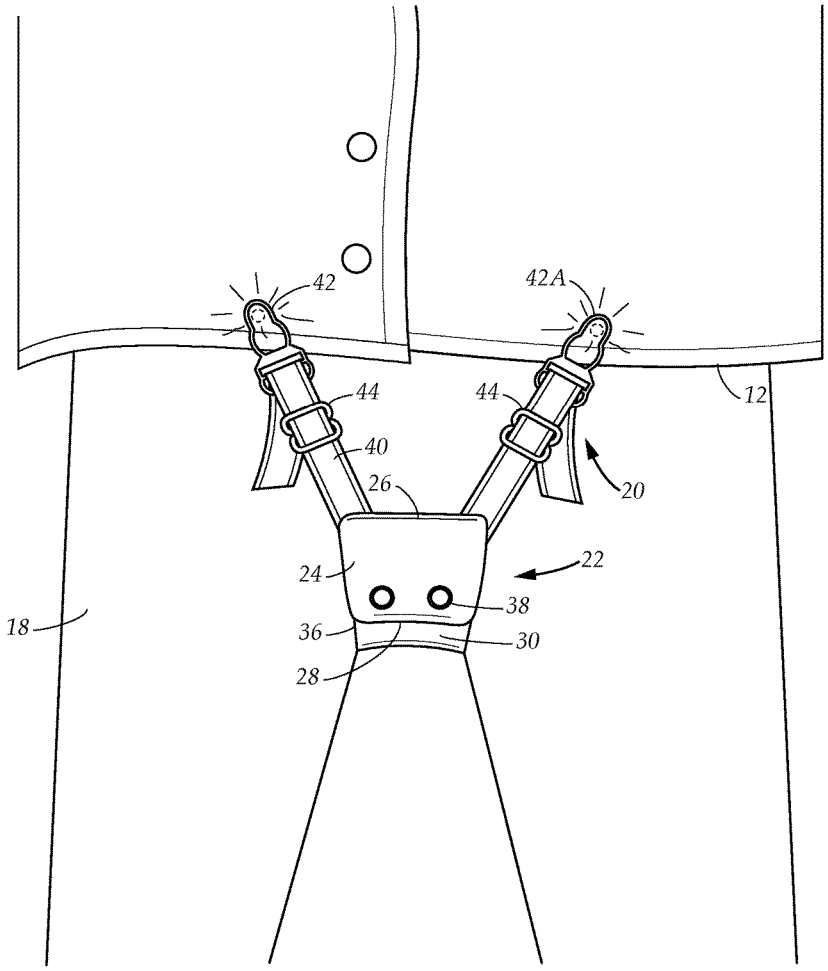
FIG. 1 is front elevational view of an example embodiment of a shirt stay, configured for a female or a child.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIGS. 1, 2, 8 and 9 illustrate an example embodiment of a shirt stay 20 for maintaining a shirttail 12 flat and fully extended, so that the shirttail remains tucked within a waistband. It is understood by those of ordinary skill that the shirttail is a bottom portion of a garment worn on an upper torso, such as a shirt, blouse, tunic, tee shirt and other similar garment. The waistband can be on a skirt, shorts, pants, trousers, kilt and other similar outer garments worn on a lower torso.

In this example embodiment, the shirt stay 20 has a crotch panel 22 and a plurality of elastic straps 40, each strap having a first end having a clasp 42 and a second end attaching to the crotch panel 22. In this example embodiment, a wearer wears the shirt stay 20 between a pair of thighs 18, the clasps 42 attaching to a front shirttail 12 and a rear shirttail to give the feel of a one-piece body suit.

In this example embodiment, the crotch panel 22 is preferably cotton. Alternatively, the crotch panel 22 has a soft stretchy cotton inner liner providing a moisture guard and outer layer of soft stretchable fabric.

Figure 8:
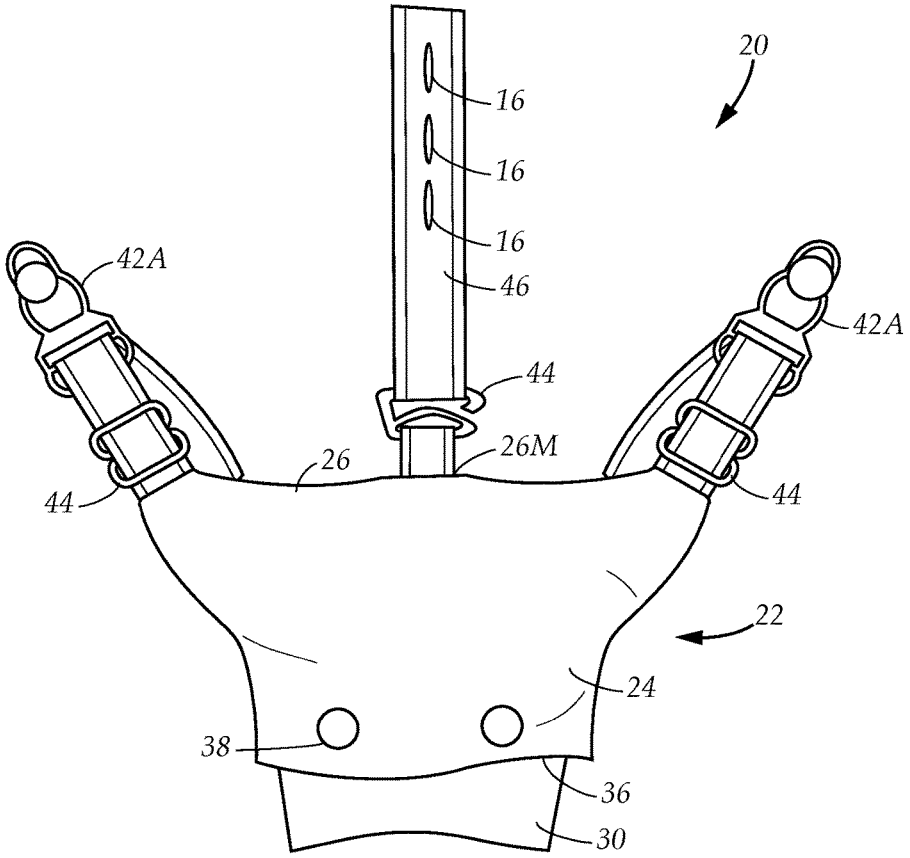
FIG. 8 is a front elevational view of yet another example embodiment of a stay.

The crotch panel 22 has a pair of panels, a front panel 24 and a rear panel 30. Each panel has a top edge and a bottom edge, a front panel bottom edge 28 and a rear panel bottom edge 34 forming an opening 36 in the crotch panel 22. The opening provides ease of access to an under garment without the need to remove the shirt stay or the shirt. For the adult wearer, the opening 36 is towards the front, for facilitating elimination. The front panel 24 of the crotch panel is shorter than the rear panel 30 of the crotch panel 22, as shown in FIGS. 1 and 8, such that the opening 36 is towards the front of the crotch panel 22, the opening configured for an adult wearer.

Figure 9:
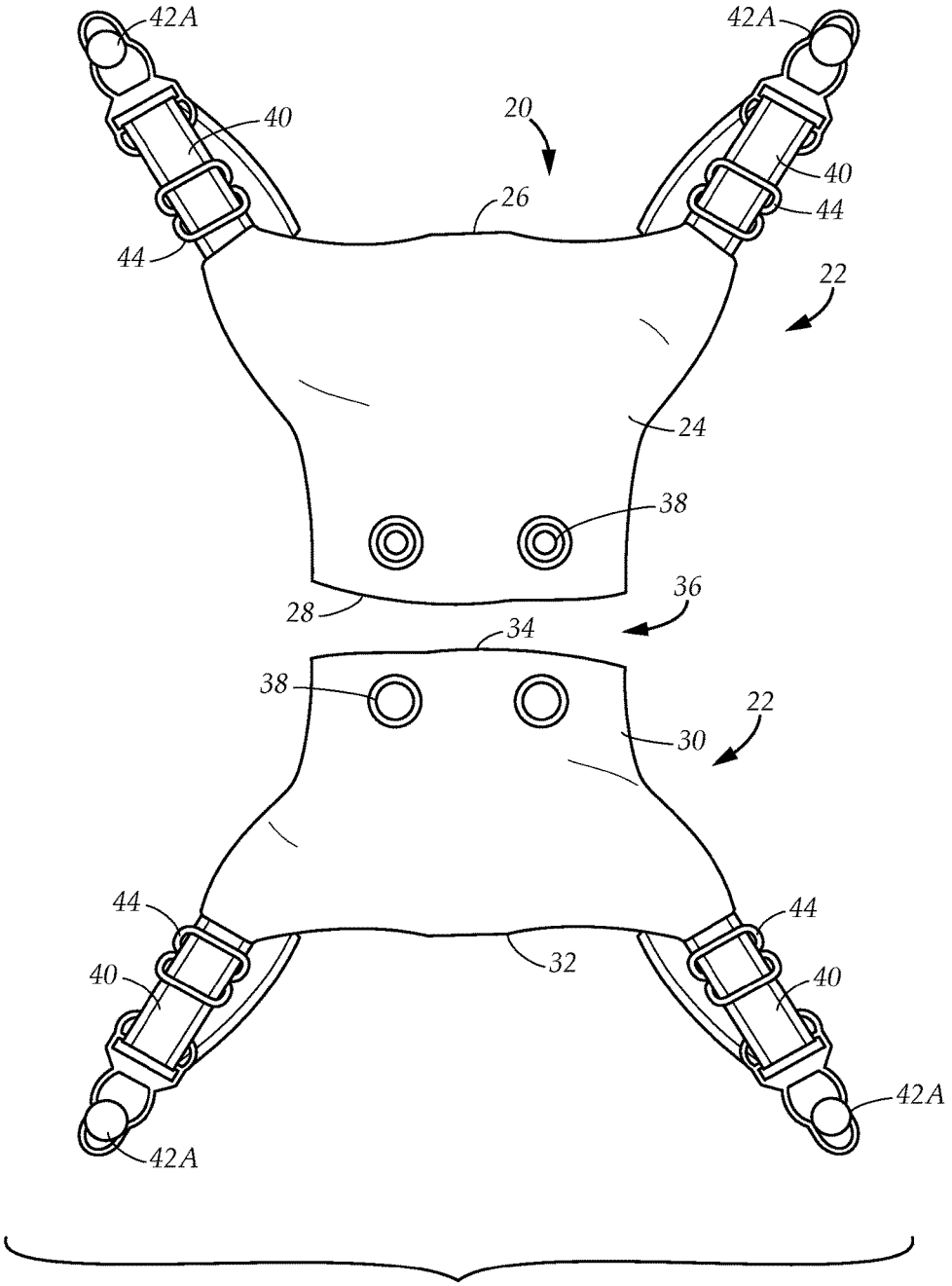
FIG. 9 is a bottom plan view of the example embodiment of a shirt stay.

If the wearer is an infant or toddler, the opening 36 is towards the middle of the crotch panel 22, enabling a diaper to be changed more easily. As shown in FIG. 9, the front panel 24 of the crotch panel 22 and the rear panel 30 of the crotch panel 22 are essentially equal such that the opening 36 is midway between the top edges of the two panels. The crotch panel 22 is essentially hourglass shaped as shown in FIG. 9.

The opening 36 is selectively opened and closed by coupling the bottom edge 28 of the front panel 24 to the bottom edge 34 of the rear panel 30 of the crotch panel 22 with a fastener 38. In the illustration, the fastener 38 is a snap but this is not a limitation. For example, the fastener can be a hook and loop fastener, buttons, a hook and eye fastener or any common garment fastener and the type of fastener is not a limitation. The fastener 38 is preferably not removable from the crotch panel 22, preventing creation of a chocking hazard, protecting an infant or toddler from accidentally swallowing a small part.

In this example embodiment, the shirt stay 20 has two pairs of elastic straps 40, a first pair of elastic straps 40 attaching to the top edge 26 of the front panel 24 and a second pair of straps 40, as seen in FIG. 9, attaching to the top edge 32 of the rear panel 30, the clasps 42 of elastic straps configured for clasping the shirttail 12 and maintaining the shirttails in a flat and fully extended position. In these figures, the clasp 42 is a garter clip 42A. However, this is not a limitation and the clasp 42 can be other styles and shapes shown throughout the drawings such as a suspender clamps 42B, a garter clasp 42C, or other garment clamps. The clasp 42 is preferably plastic for ease in clearing security metal detectors as well as being more comfortable against the skin. Each elastic strap 40 has a slider 44 to adjust the length of the strap. The elastic straps 40 are advantageously positioned close to the shirttails 12 and are relatively short compared to elastic straps in the prior art, making the shirt stay safer to use with infants and toddlers by minimizing the possibility of strangulation.

Figure 2:
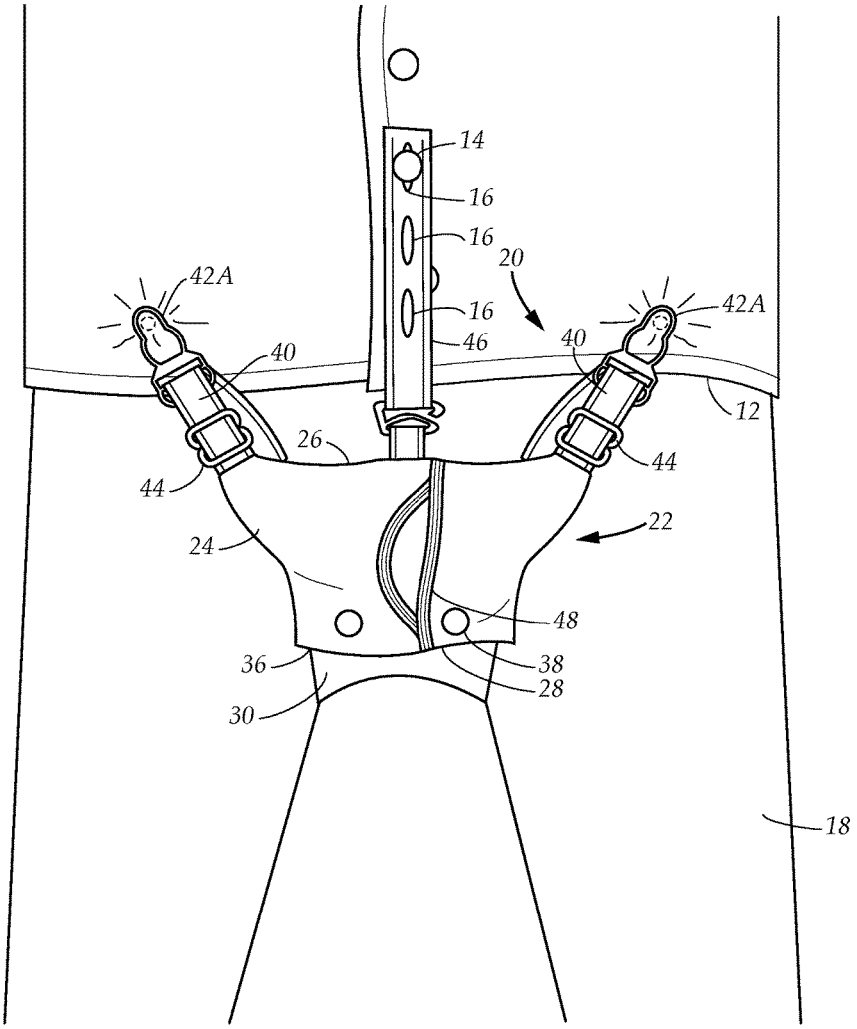
FIG. 2 is a front elevational view of another example embodiment of a shirt stay configured for a male.

FIGS. 8 and 2 show a further means of securing the shirttail 12. A buttonhole strip 46 having a plurality of buttonholes 16 attaches to the top edge 26 of the front panel 24, at a middle 26M, the buttonholes 16 configured for selectively buttoning to a bottommost shirt button 14.

FIG. 2 also illustrates the shirt stay 22 having a fly front opening 48, configured for a male wearer.

Figure 3:
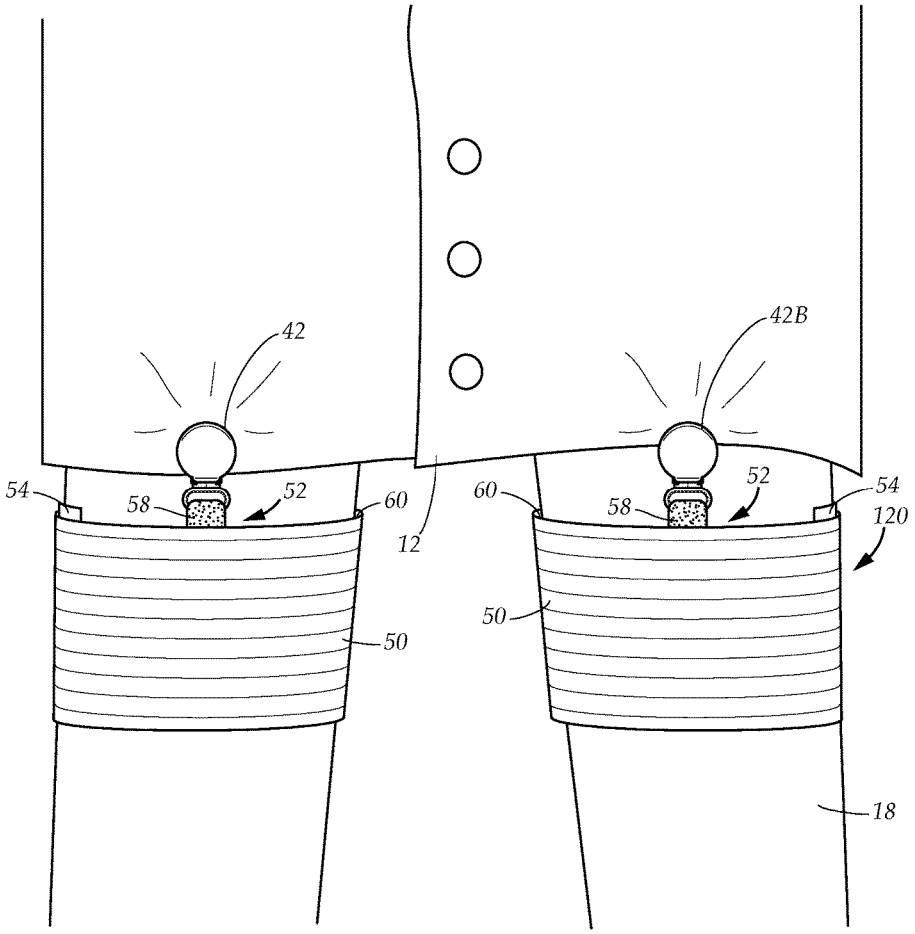
FIG. 3 is a front elevational view of a further example embodiment of a shirt stay.
Figure 4:
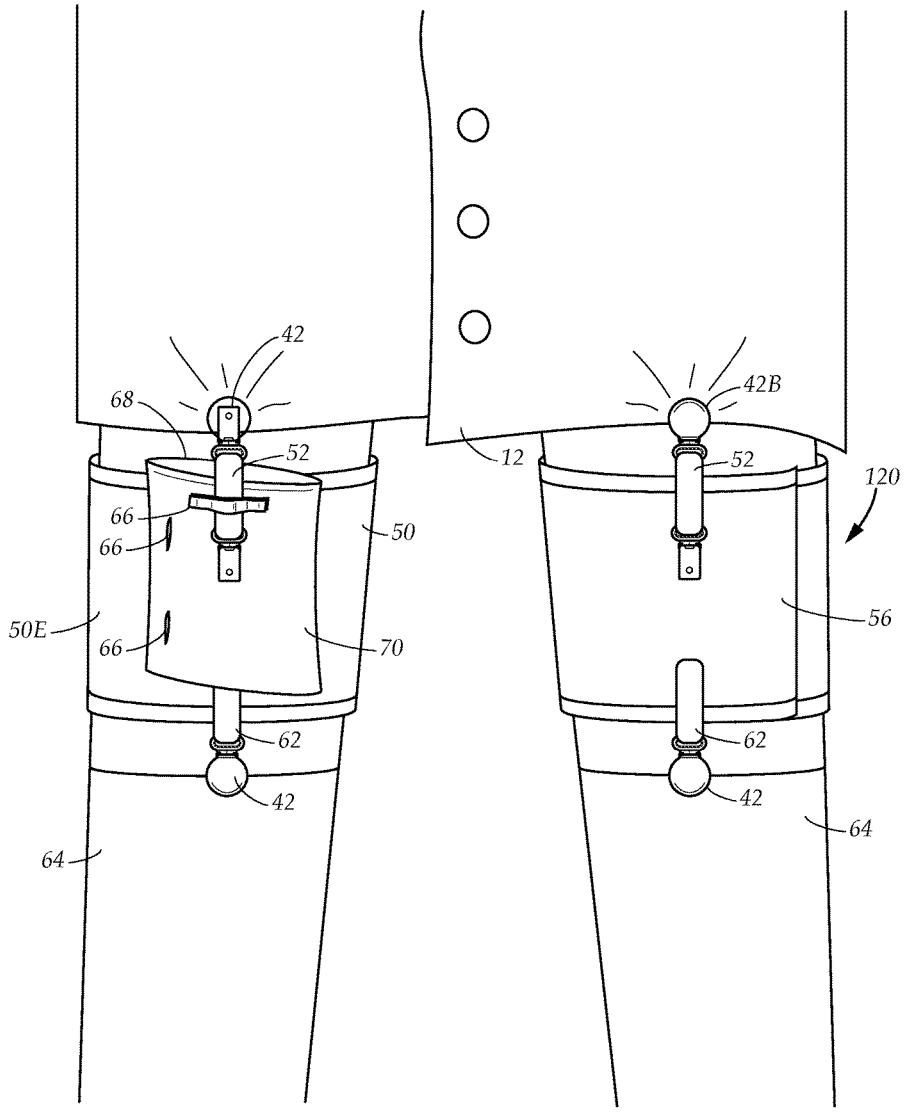
FIG. 4 is a front elevational view of yet a further example embodiment of a shirt stay.

FIGS. 3 and 4 show another example embodiment of the shirt stay 120. The shirt stay 120 has an elastic thigh band 50 and a plurality of straps 52 configured for selectively attaching to the thigh band 50, each strap having a clasp 42 on a first end, the clasps configured for clasping and maintaining a shirttail 12 in a flat and fully extended position.

The wearer preferably wears a pair of thigh bands 50.

As shown in the example embodiment in FIG. 3, each strap 52 has a hook material surface 58, the hook material surface configured for selectively attaching to a surface of the thigh band 50. In the illustration, the strap attaches to an inner surface of the thigh band 50. Each strap 52 has a soft loop material surface opposite the hook material surface so that the strap presents a soft surface next to skin when attaching to a surface of the thigh band 50.

In another example embodiment, the strap 52 is constructed from double-sided hook and loop material. The strap 52 is sewn onto the clasp 42 and adheres anywhere on thigh band 50, providing a customized fit. The double-sided material allows the wearer to place the strap in a preferred position, anchoring the shirttail 12 in position. Preferably the hook material faces away from the skin to prevent irritation. Auxiliary straps 52 can be selected from the group that includes but is not limited to hook and loop material, elastic or combination of both, maximizing movement flexibility.

In these figures, the clasp 42 is a suspender clamp 42B. However, as explained hereinabove, this is not a limitation. The clasp 42B is preferably plastic for ease in clearing security metal detectors as well as being more comfortable against the skin.

In one example embodiment, the elastic thigh band 50 stretches in a horizontal direction. Stretching in a vertical direction is inhibited by at least one non-elastic vertical tape strip 54 configured for preventing the elastic thigh band 50 from stretching in a vertical direction and rolling, thereby maintaining the straps 52 at a fixed distance from the shirttail 12. The thigh band is made from a breathable fabric that stretches in one direction such as neoprene, spandex or elastane. When neoprene is used, the surface provides loop material for connecting to hook material.

In another example embodiment shown in FIG. 4, the elastic thigh band 50 is an open loop having a non-elastic vertical closure 56 configured for closing the thigh band 50 when it is looped around the thigh 18, the vertical closure 56 preventing the elastic thigh band 50 from stretching in a vertical direction and rolling, but allowing the thigh band to stretch in the horizontal direction, thereby maintaining the straps at a fixed distance from the shirttail. The thigh bands 50 are easily removed allowing easy access to undergarments. The vertical closure 56 can be, for example, a hook and loop closure, a zipper, a plurality of snaps, a plurality of hooks and eyes and the type of closure employed is not a limitation.

In one example embodiment, the non-elastic vertical closure 56 is a hoop and loop fastener. The vertical closure 56 has rounded edges to protect against skin irritation.

The straps 52 selectively attach to a surface of the thigh band 50. The wearer chooses which surface to attach the straps 52; the surface can be an interior surface or an exterior surface.

The shirt stay 120 can include a plurality of auxiliary straps 62 having an end with a clasp 42, the auxiliary straps selectively attaching to the thigh band 50 and extending downwards, the auxiliary straps configured for clasping and maintaining a stocking 64 in a proper position on the thigh 18.

The shirt stay can include a security pouch 70 attaching to an exterior surface 50E of the thigh band 50 with a horizontal opening 68. The security pouch 70 provides a safe place to hide identification and money. In one example embodiment, the pouch 70 attaches by hook and loop material. Alternatively, the strap 50 attaches to the pouch through a loop 66. The pouch can be placed so that the opening 68 can be vertical.

Figure 10:
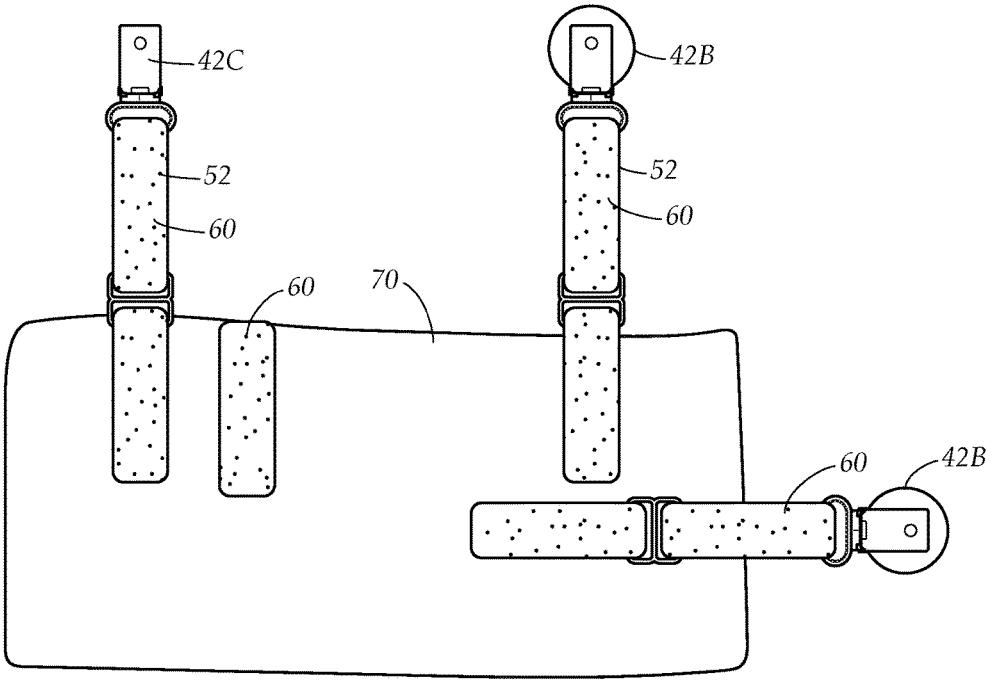
FIG. 10 is front elevational view of an example embodiment of a pouch attachment.

FIG. 10 shows another example embodiment of the pouch 70. The straps 52 have loop material 60, the hook material on the reverse, attaching to the pouch 70. The pouch 70 attaches by the loop material 60 on the straps 52 to the thigh band when the thigh band has hook material on external surface.

Figure 7:
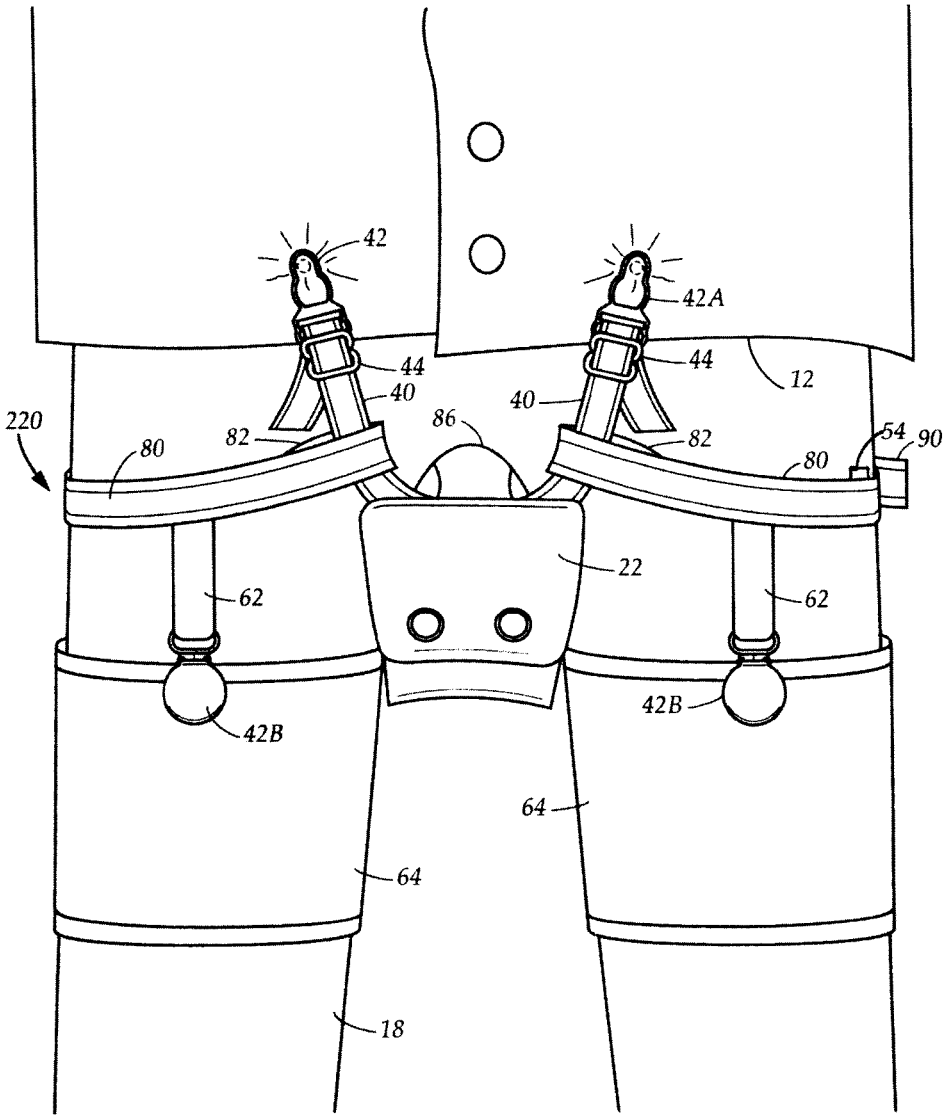
FIG. 7 is a front elevational view of still a further example embodiment of a combination shirt stay.
Figure 11:
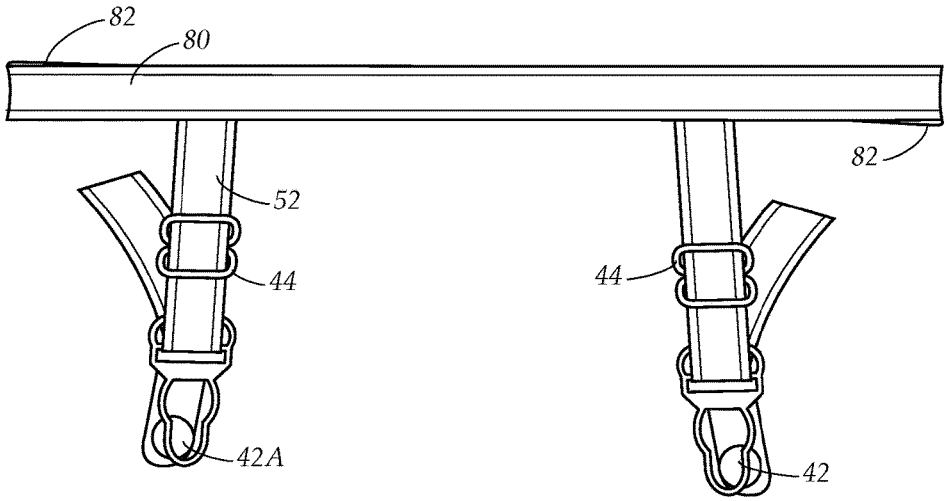
FIG. 11 is a front elevational view of an example embodiment of a thigh belt included in a shirt stay kit.

FIGS. 7 and 11 shows a further example embodiment of the shirt stay 220 combining the crotch panel 22, as described hereinabove, with a plurality of elastic thigh belts 80. In one example embodiment, the thigh belts 80 are provided in a pair, each having a pair of portions, a front portion and a rear portion. The elastic thigh belt is configured to curve around the thigh 18. Each thigh belt 80 has a loop end 82 and a non-elastic vertical closure 90 that joins the front portion and the rear portion. The closure 90 has rounded edges to protect against skin irritation.

In one example embodiment, the closure ends 90 are preferably hook and loop material but also can be, for example, a buckle, a plurality of snaps, a plurality of hooks and eyes, the type of closure employed is not a limitation.

The example embodiment has a plurality of adjustable length straps 40 with the clasps 42 that attach to the crotch panel 22 and selectively attach to the thigh belt 80.

The elastic straps 40 on the crotch panel 22 selectively connect to each of the thigh belts 80 by the connector loops 82. The clasp 42 of adjustable length strap 40 inserts through the thigh belts loop 82 clasping the shirttail 12 providing tension to the shirt stay and maintaining the shirttail in proper position. The rear portion of the thigh belt 80 is a mirror image of the front portion and connects accordingly, as described hereinabove.

In one example embodiment, the thigh belt 80 stretches in a horizontal direction. Stretching in a vertical direction is inhibited by at least one non-elastic vertical tape strip 54 configured for preventing the elastic thigh belt 80 from stretching in a vertical direction and rolling, thereby maintaining the straps 62 at a fixed distance from the stocking 64. The thigh belt is made from a breathable fabric that stretches preferably in one direction, such as neoprene, spandex or elastane. When neoprene is used, the surface provides loop material for connecting to hook material. The fabric or material employed is not a limitation.

The shirt stay 220 can include a plurality of auxiliary straps 62 having an end clasp 42; the end clasp can be a garter clip 42A, suspender clamp 42B or a garter clasp as described hereinabove. The auxiliary straps 62 selectively attach to the thigh belt 80 and extend downwards, the auxiliary straps configured for clasping and maintaining a stocking 64 in a proper position on the thigh 18.

Auxiliary straps 62 may be hook and loop material, elastic or a combination of both for movement flexibility. The auxiliary straps 62 may be attached to thigh belt 80 by alternative methods, such as snaps. The ways of attaching straps 62 onto belt 80 is not a limitation.

The straps 62 selectively attach to a surface of the thigh belt 80. The wearer chooses which surface to attach the straps 62; the surface can be an interior surface or an exterior surface.

The elastic straps 40 have sliders 44 for adjusting the length of the elastic straps.

The crotch panel 22 is essentially hourglass shaped, varying from slightly to substantially hourglass shaped to accommodate the wearer. In this embodiment, it is preferable that the shirt stay 220 has two pairs of thigh belts 80 for front and rear of each thigh.

In a further example embodiment, a thigh belt is continuous, extending from front to rear, the shirt stay 220 having a pair of continuous belts.

In the illustration, the front of the shirt stay 220 is shown, it is understood by those of ordinary skill that the rear of the shirt stay is the mirror image of the front of the shirt stay 220.

Figure 5:
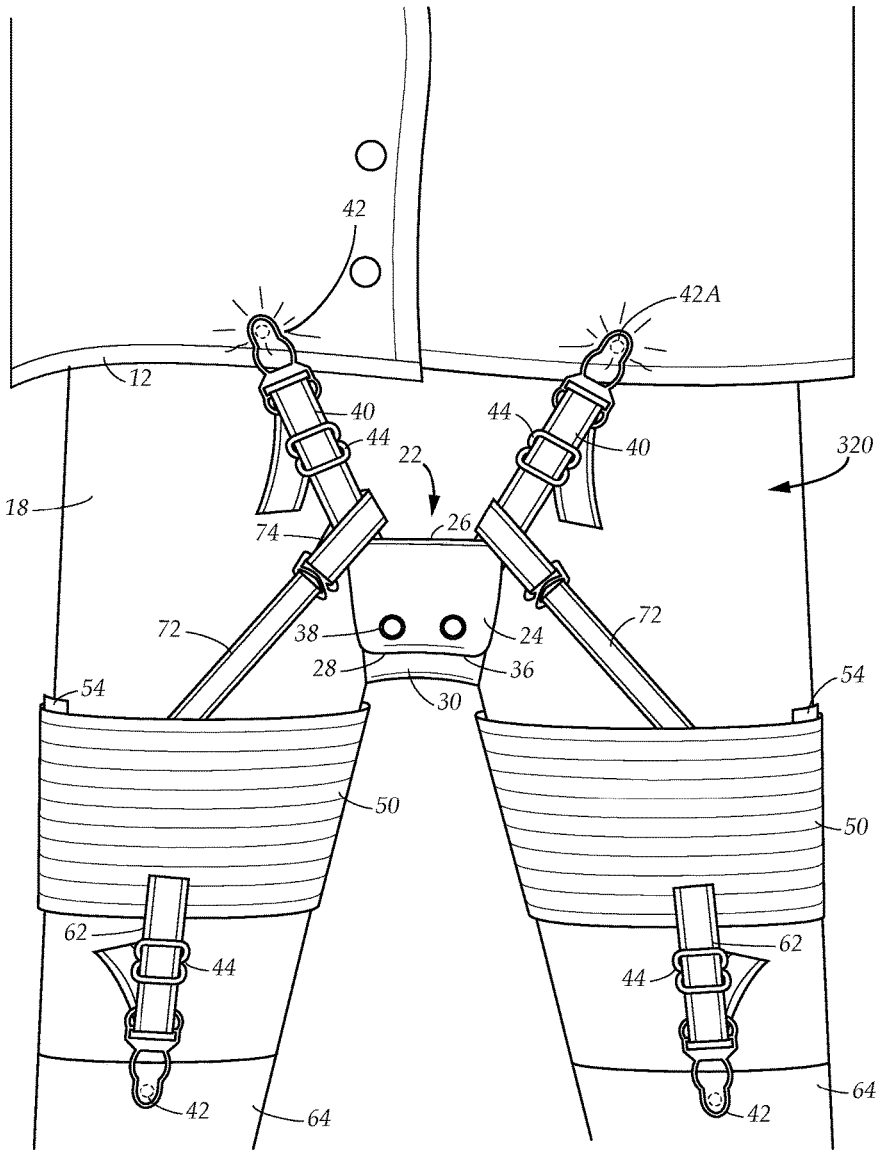
FIG. 5 is a front elevational view of still another example embodiment of a shirt stay.
Figure 6:
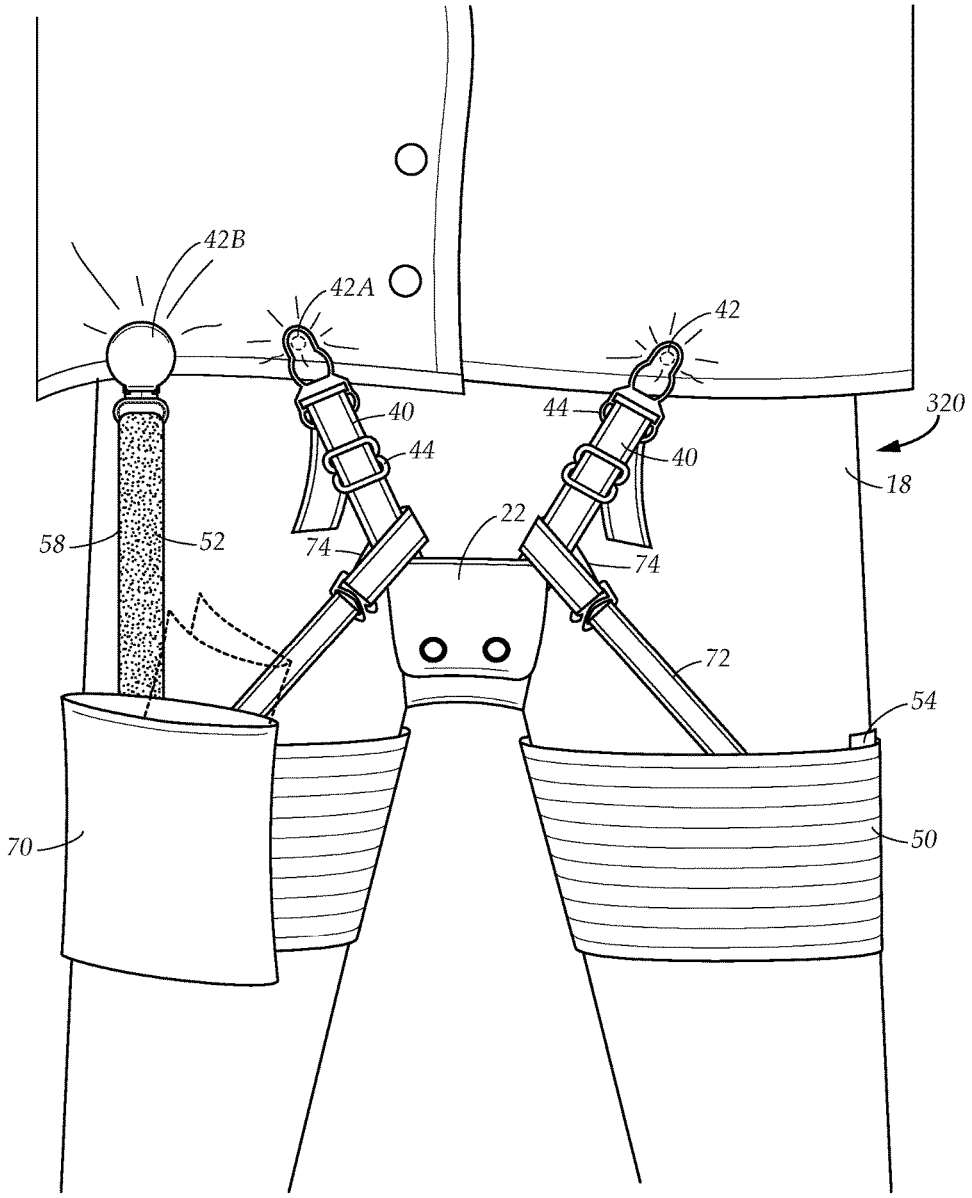
FIG. 6 is a front elevational view of yet another example embodiment of a combination shirt stay.

Yet another example embodiment of the shirt stay 320 is illustrated in FIGS. 5 and 6, combining a crotch panel 22 with a pair of elastic thigh bands 50. As explained hereinabove, the crotch panel 22 has a front panel 24 and a rear panel 30 that form the opening 36 that is selectively closes with the fastener 38. The example embodiment has a plurality of adjustable length straps 40 with the clasp 42 that attach to the crotch panel 22 and selectively attach to the thigh bands 50.

The elastic straps 40 on the crotch panel 22 selectively connect to the thigh bands by a plurality of connector straps 72. A connector strap 72 has a loop 74 on a first end. The clasp 42 of adjustable length strap 40 inserts through the loop before clasping the shirttail 12. In the illustration, the front of the shirt stay 320 is shown, it is understood by those of ordinary skill that the rear of the shirt stay is the mirror image of the front of the shirt stay 320.

The connectors 72 have sliders 44 for adjusting the length of the connectors.

The crotch panel 22 is essentially hourglass shaped, varying from slightly to substantially hourglass shaped to accommodate the wearer. The elastic thigh band 50 has the vertical tape strip 54 as explained hereinabove.

The shirt stay 320 can include a plurality of auxiliary straps 62 having the clasp 42 attaching to the thigh band 50 and extending downwards, clasping and maintaining a stocking 64 in a proper position on the thigh 18 as explained hereinabove.

As shown in FIG. 6, various elements are combinable as a kit. The shirt stay 320 assembled from the kit includes the pair of thigh bands 50, the crotch panel 22 and the elastic straps 40 with clasps 42, as described herein above. The straps 52 with clasps 42 and the double-sided hook 58 and loop material as described hereinabove may supplement or replace the elastic straps 42 and vice versa. The security pouch 70 and the connectors 72 as described hereinabove can be added to the thigh band 50. The kit can include a plurality of auxiliary straps 62 for grasping stockings 64 as shown in FIG. 5.

The kit can also include the plurality of thigh belts 80 as shown in FIG. 7 and described hereinabove as well as the buttonhole strip shown in FIG. 2 and described hereinabove.

In another example embodiment of the kit, the crotch panel 22 shown in FIG. 2 includes the fly front opening 48 as described hereinabove in a kit for use by a male wearer.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a shirt stay. The disclosure is illustrated by example in the drawing figures, and throughout the written description. It should be understood that numerous variations are possible, while adhering to the inventive concept. Such variations are contemplated as being a part of the present disclosure.

What is claimed is:

1. A shirt stay for maintaining shirttails in a flat and fully extended position, comprising:

a pair of elastic thigh bands; each of the elastic thigh bands configured to wrap around a high of wearer;

a crotch panel having a pair of panels, a front panel and a rear panel, each panel having a top edge and a bottom edge, the bottom edges of the front and rear panels forming an opening in the crotch panel, the opening selectively closing by a fastener;

a plurality of elastic straps, each elastic strap of the plurality of elastic straps having a pair of ends, each said elastic strap of the plurality of elastic straps having a first end having a clasp configured for clasping a shirttail, each said elastic strap having a second end attaching to the crotch panel; and a plurality of connector straps, a first end of each connector strap connecting to one of the plurality of elastic straps and attaching on the crotch panel to one of the pair of the elastic thigh bands, providing tension to the shirt stay and maintaining the shirttail in a proper position; wherein said one of the elastic thigh band has at least one vertical tape strip configured for preventing the elastic thigh band from stretching in a vertical direction and rolling, thereby maintaining the elastic straps at a fixed distance from the shirttail.

2. The shirt stay as described in claim 1, wherein said each of the plurality of connector straps and said each of the plurality of elastic straps has a slider, the slider configured for adjusting length of the connector straps and adjusting length of the elastic straps.

3. The shirt stay as described in claim 1, further comprises a security pouch attaching to an exterior surface of the elastic thigh band, and a strap connecting the pouch to the shirttail.

* * * * *